US005765629A

United States Patent [19]

Goldsmith et al.

[11] Patent Number: 5,765,629

[45] Date of Patent: Jun. 16, 1998

[54] STEAM CONDENSING APPARATUS WITH FREEZE-PROTECTED VENT CONDENSER

[75] Inventors: James David Goldsmith, Katy; George Edward Kluppel, Richmond; George Steve Millas, Houston, all of Tex.; Thomas Wayne Strock, Jackson Township, Stark County, Ohio

[73] Assignee: Hudson Products Corporation, Houston, Tex.

[21] Appl. No.: 585,342

[22] Filed: Apr. 10, 1996

[51] Int. Cl.[6] ..... F28B 9/10

[52] U.S. Cl. ..... 165/112; 165/913; 165/111; 165/144; 165/113

[58] Field of Search ..... 165/144, 112, 165/111, 110, 113, 913, 910

[56] References Cited

U.S. PATENT DOCUMENTS

| | | | |
|---|---|---|---|
| 3,710,854 | 1/1973 | Staub | 165/111 |
| 3,968,836 | 7/1976 | Larinoff | 165/111 |
| 4,045,961 | 9/1977 | Schoonman | 165/111 X |
| 4,129,180 | 12/1978 | Larinoff | 165/111 X |
| 4,903,491 | 2/1990 | Larinoff | 165/111 X |
| 5,139,083 | 8/1992 | Larinoff | 165/113 |

*Primary Examiner*—John Rivell
*Assistant Examiner*—Christopher Atkinson
*Attorney, Agent, or Firm*—Robert J. Edwards; Michael L. Hoelter

[57] ABSTRACT

A two-stage steam condenser that prevents freezing from occurring in the tube rows by continual purging of the tube rows. Such continual purging prevents any steam from back-flowing into a tube row thereby eliminating the possibility that condensate or noncondensable gases will become trapped therein. This is achieved by isolating each of the tube rows in the second stage of the condenser so that the pressure of one tube row is not exposed to the pressure occurring in another adjacent tube row. The condensate collected in the various tube rows of this second stage is delivered to a common drain pot that is hydraulically balanced to accommodate the various pressures in these tube rows. Such hydraulic balancing also prevents any back-flowing from occurring from one tube row into another. Furthermore, in this second stage of the steam condenser, the steam and resulting condensate both flow concurrently downward while any noncondensable gases are vented counter-currently upward against such steam and condensate flow.

12 Claims, 7 Drawing Sheets

STEAM CONDENSING APPARATUS WITH FREEZE-PROTECTED VENT CONDENSER

FIELD OF THE INVENTION

This invention pertains in general to heat transfer systems for vapor condensation and more particularly to a two-staged air cooled steam condenser having built-in freeze protection accomplished by the elimination of any backflow into individual heat exchange tubing.

BACKGROUND OF THE INVENTION

Many industries make use of heat transfer equipment in order to condense water vapor or steam. Such equipment is generally coupled to the exhaust of low pressure turbines in order to condense the steam to liquid for reuse. A primary function of the steam condenser is to provide a low back-pressure, typically in the range of 1.0 to 6.0 inches Hg absolute, at the turbine exhaust to permit the turbine to operate at maximum efficiency.

There are basically two types of steam condensers available, those that are water-cooled and those that are air cooled. While water-cooled steam condensers are currently the dominant technology, air-cooled steam condensers are being used more frequently in order to comply with strict environmental requirements.

Single-stage air cooled steam condensing systems are generally constructed in an A-frame shape with a steam duct or manifold at the apex of the triangle and a fan at its base. This fan is used to force air through the two inclined side condenser tube bundles. Steam initially enters these tube bundles at their upper end with the vapor and resulting condensate flowing downward toward a common lower header.

Each tube bundle generally consists of multiple rows or layers of individual tubes. As air passes each successive row, its temperature naturally increases which results in a decrease in the temperature differential between this air and any subsequent tube row. Consequently, less condensation and vapor flow occurs for each successive tube row thereby also reducing the vapor pressure drop for that tube row.

In condenser designs having their various tube rows discharging into a common lower header, problems will occur.

These problems arise because of the different vapor exit pressures for each tube row. Consequently, steam and non-condensable gases from the higher pressurized tubes (i.e. those farthest from the fan) will enter the end opening of the lesser pressurized tubes (i.e. those closest to the fan) and become trapped therein. Noncondensable gases, typically air, occur in the system due to leaks through steam piping connections or at the turbine seals. Thus, since this vapor is now entering both ends of a tube, any trapped condensate is subject to freezing and rupture during cold weather. During warm weather, such trapping can result in thermal performance losses. Also, these air pockets blanket the heat transfer surface of the tube thereby reducing its cooling capacity.

Consequently, the primary technical challenge facing air-cooled steam condensers is to efficiently drain the condensate and remove any noncondensable gases from the tubes while also minimizing turbine back pressure. One solution to this problem is the single-stage condenser disclosed in U.S. Pat. No. 4,129,180 to Larinoff. In this single-stage arrangement, complete and total separation of the various tube rows is maintained. Thus, rather than discharging into a common lower header, the various tube rows exit into a divided lower header so as to maintain their isolation from each other. Each division of this lower header is then independently routed or coupled to a common drain pot having water leg seals that balance the different pressures. Furthermore, to maintain such complete and total separation between the various tube rows, the vent lines used to vent the noncondensable gases which flow upward in inclined tubes are independently routed to individual vacuum pumps or ejectors for eventual atmospheric discharge.

U.S. Pat. No. 4,903,491 to Larinoff offers a variation of the water leg seal used in his single-stage condenser to balance the different pressures between the separate tube rows of a single-stage condenser.

An alternate solution to this problem is the use of a two-stage condenser. In such an arrangement, the first or main condenser is used to condense about two thirds of the incoming steam with the resulting condensate and excess steam being discharged into a common lower header. Such excess steam flowing through the main condenser consistently purges these tube rows. It also equalizes the pressure drop across each tube row to prevent backflow into the tube.

This excess steam (and any noncondensable gas therein) is then delivered to a secondary condenser, typically a dephlegmator condenser. This secondary condenser is generally constructed similar to the main condenser as an A-frame with an underneath fan forcing air through the inclined side tube bundles. Usually, this secondary condenser is configured with a fourth to a third of the total condenser surface area of the two-stage condenser so as to insure the passage of excess steam through the main condenser.

In a dephlegmator condenser, the steam and noncondensable gases enter the tube rows from a common lower inlet header and flow upward therein toward a common upper discharge header. The resulting condensate, in contrast, flows downward counter to the steam flow back into the common lower inlet header. This common lower inlet header then directs such condensate to a drain. It also may provide passage of the excess steam from the main condenser to the lower inlet header of the dephlegmator.

Unfortunately, the above two-stage design usually works best only at design operating conditions of steam flow, ambient temperature, and air flow rate. Any variation from these design conditions significantly alters the operating characteristics of the condenser. For example, a reduction in steam flow will reduce the excess steam flowing through the main condenser to the secondary condenser. This reduction in excess steam results in varying steam exit pressures and the potential for steam and noncondensable gas to back flow into some of the tube rows of either or both the main condenser or the secondary condenser.

Other solutions to the above trapping and freezing problem involve fixed orifices or flapper valves for equalizing the pressure drop between the tube rows. Also, some designs may vary the tube fin spacing, fin height, or finned length from row to row in an attempt to achieve balanced steam condensation and pressure drop across the tube bundle. Still other solutions involve horizontally arranged tubes with multiple passes. In such an arrangement, the flow through each horizontal tube experiences a similar cooling potential and therefore has a to similar condensation rate and pressure drop. In any event, all of the above solutions either perform only at the steam condenser design operating conditions or have a high cost/benefit ratio thereby eliminating their competitiveness.

It is thus an object of this invention to provide a two-stage steam condenser that eliminates the problems associated with trapped noncondensable gases. A further object of this invention is to provide a steam condenser that maintains a low back-pressure to the turbine while providing freeze protection for the condensate that is collected. Still another object of this invention is to provide a two-stage steam condenser that is capable of operating under a variety of conditions, not just design conditions, and which is capable of providing freeze protection under these various conditions. Yet another object of this invention is to reduce the need for condensate and air removal piping thereby reducing the cost of manufacture of the steam condenser. Still another object of this invention is to insure the continuous purging of the tube rows thereby preventing any back flow from occurring. These and other objects and advantages of this invention will become obvious upon further investigation.

SUMMARY OF THE INVENTION

This invention pertains to a two-stage air-cooled steam condenser having a main condenser that partially condenses steam therein. This main condenser incorporates a common lower discharge header that both collects excess steam therein and discharges any condensate into a drain pot. A vent condenser is coupled downstream of this main condenser with this vent condenser being sized and configured to condense the excess steam received from the main condenser. This vent condenser incorporates a plurality of independent tube rows that receive the excess steam from a common upper inlet header. A piping assembly delivers this excess steam from the common lower discharge header of the main condenser to the common upper inlet header of the vent condenser whereby both the excess steam and any resulting condensate flow concurrently downward within the vent condenser. A compartmented discharge header is secured to the lower discharge region of the vent condenser with each such compartment being coupled to a separate tube row for the segregated collection of condensate within each such compartment. A separate drain assembly is coupled to each compartment for separately discharging the segregated condensate into the drain pot. A weir assembly in the drain pot removes condensate from the drain pot and is configured with an entrance opening at an elevation above the discharge end of each drain assembly.

DESCRIPTION OF THE PREFERRED EMBODIMENTS

Figure 1:
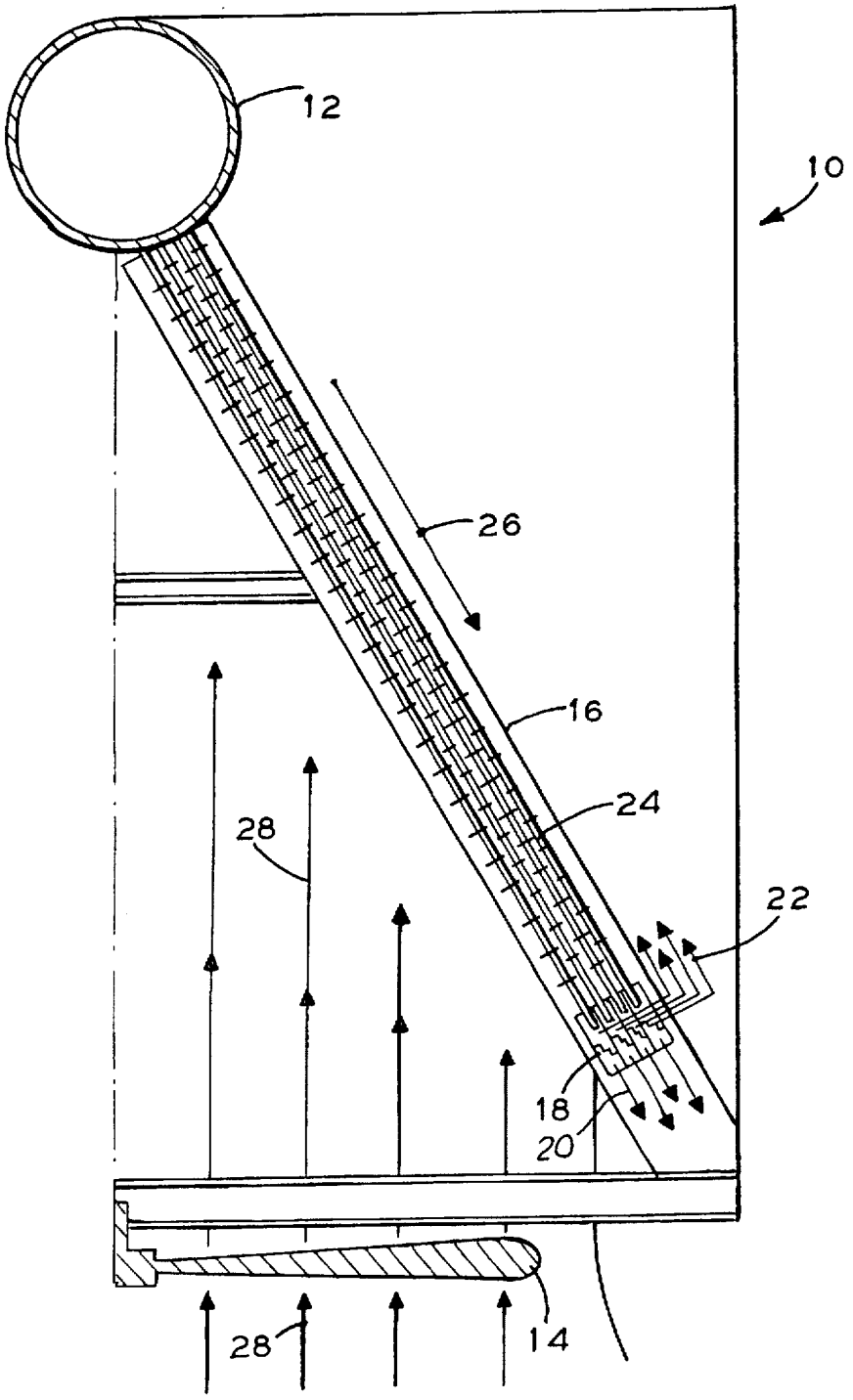
FIG. 1 (PRIOR ART)
FIG. 1 is a pictorial view illustrating a portion of a typical single-stage A-frame steam condenser showing a common direction of steam, condensate, and noncondensable gas flow therethrough.

Referring initially to FIG. 1, there is shown a typical single-stage steam condenser 10 which is characteristic of many of the single-stage condensers currently in use. Steam condenser 10 is configured in an A-frame shape with steam header 12 at the apex of the triangle and with fan 14 forming the base of the triangle. Inclined tube bundles 16 extend down from steam header 12 and form the opposite sides of this A-frame shape. These inclined tube bundles discharge into divided lower header 18 which maintains separate condensate lines 20 and vent lines 22. The independent condensate lines 20 from lower header 18 flow to a common drain pot which incorporates water leg seals in order to balance the different pressures within each of tube rows 24. The independent vent lines 22 from lower header 18 are separately routed to individual vacuum pumps or ejectors for eventual discharge to the atmosphere. As shown, steam and condensate 26 both flow in the same direction downward from steam header 12 toward lower header 18 while air 28 flows upward through fan 14.

Figure 2:
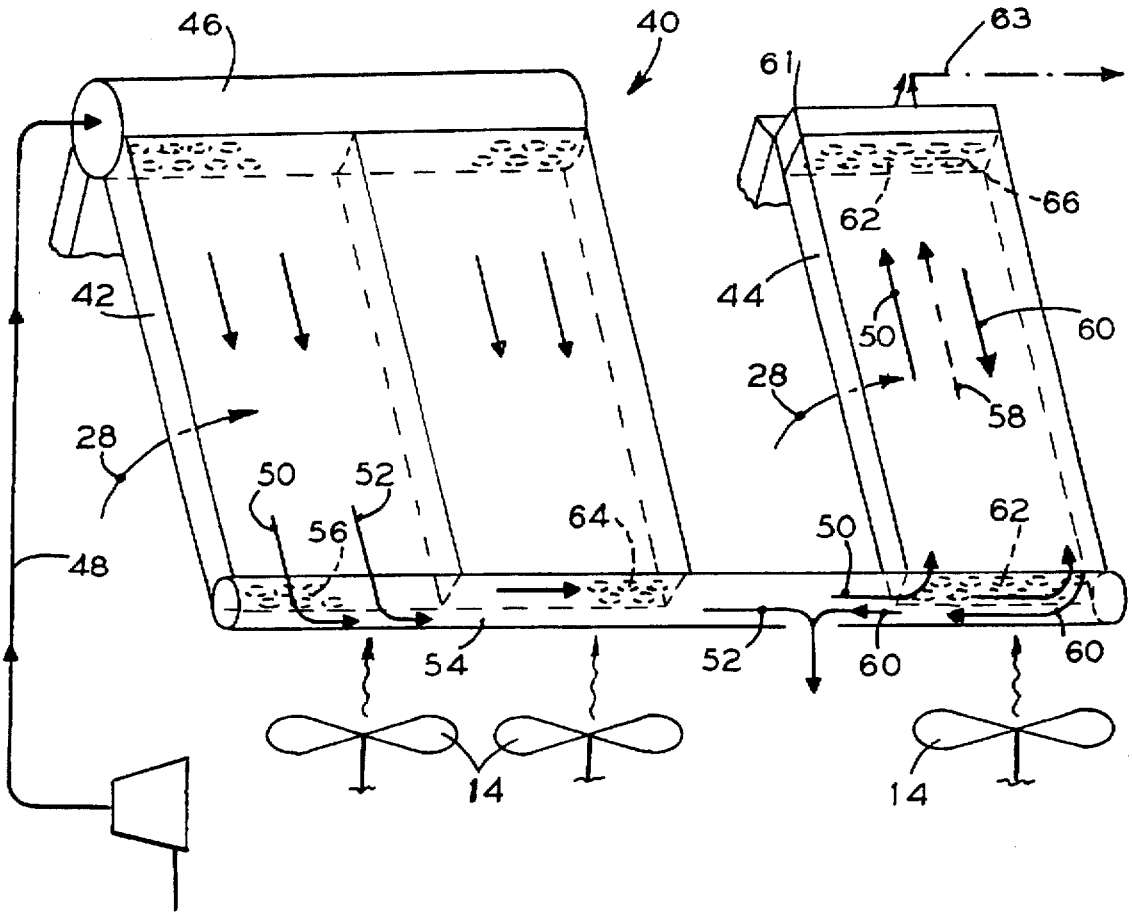
FIG. 2 (PRIOR ART)
FIG. 2 is a pictorial view illustrating a portion of a typical two-stage steam condenser incorporating a main and a secondary condenser along with a common direction of flow of the steam, condensate, and noncondensable gases therethrough.

Referring now to FIG. 2, there is shown a typical two-stage steam condenser 40 which is characteristic of many of the two-stage condensers currently in use. Such two-stage condensers 40 consist of main condenser 42 and downstream secondary condenser 44 which is typically a dephlegmator condenser. Generally, main condenser 42 comprises about two-thirds of the heat exchanger surface area required to fully condense the incoming steam while secondary condenser 44 comprises the remainder of such surface area so as to completely condense the excess steam received from main steam header 46. Since main condenser 42 is not sized to condense all of incoming steam 48, the excess steam 50 as well as any condensate 52 both flow concurrently downward into common lower header 54. This excess steam 50 is intended to equalize the pressure drop across each tube row 56 in main condenser 42 so as to prevent any back flow into any such tube row 56. Excess steam 50 is then delivered via common lower header 54 to the lower inlet of dephlegmator 44. In dephlegmator 44, this steam 50 and any noncondensable gases 58 (usually air leakage into the system through piping connections or equipment seals) flow upward with the resulting condensate 60 flowing counter-currently downward back into common lower header 54. Afterwards, condensate 60 is removed from lower header 54 through normal channels. Noncondensable gases 58 enter common upper discharge header 61 and are discharged by common line 63. This design does not include any type of pressure equalization mechanism to balance the difference in pressures that may occur between the various tube rows 62 of secondary condenser 44.

Consequently, in secondary condenser 44, it is likely that the higher pressure from one tube row 62 (i.e. those farthest from the fan) will cause backflow into other tube rows 62 (i.e. those closest to the fan). Furthermore, in such a typical two-stage steam condenser 40, it is also likely that in main condenser 42, the downstream tubes (i.e. those farthest from the steam turbine) will be subject to less pressure than adjacent upstream tubes (i.e. those closest to the steam turbine) resulting in the possibility that backflow will occur in these downstream tubes thereby trapping condensate 52 therein. Additionally, in main condenser 42 and at the most downstream portion thereof, back flow may occur from the upper tubes into the lower tubes (i.e. those farthest from the fan into those closest to the fan).

Thus, should the design operating conditions of two-stage condenser 40 not be maintained as intended, it then becomes likely that the exiting pressure of excess steam 50 from main condenser 42 will vary thereby creating the potential for such steam 50 and noncondensable gas 58 to back flow into one or more tube rows 56 of main condenser (see area 64). Additionally, such variation in the exiting pressure of excess steam 50 may also permit a back flow of steam 50 and noncondensable gas into one or more tube rows 62 of secondary condenser 44 as well (see area 66). Thus the potential problem of freezing and tube rupture remains.

Figure 3:
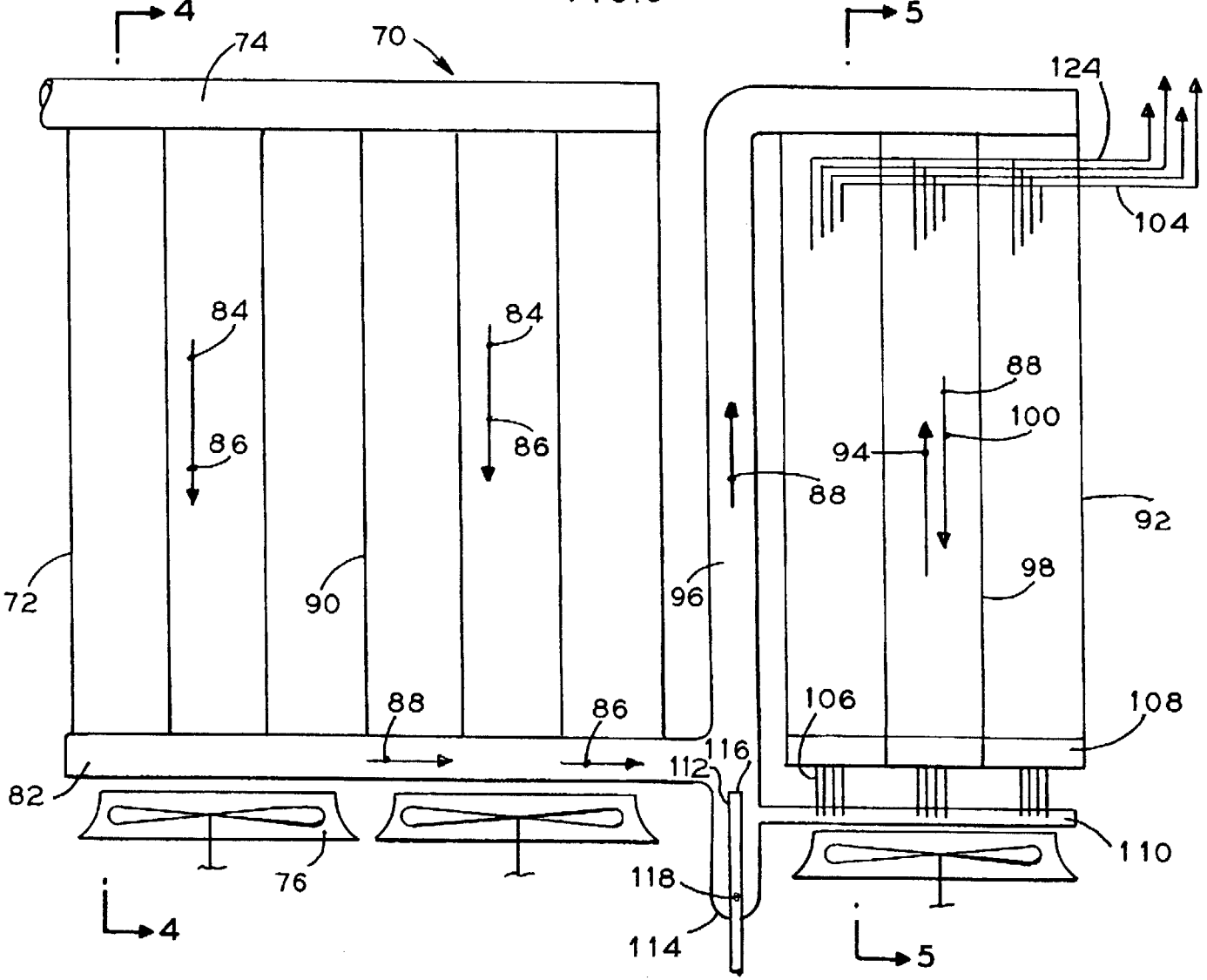
FIG. 3 is a pictorial view of one embodiment of the two-stage steam condenser comprising the invention described herein showing a main condenser and a vent condenser along with the direction of flow of the steam, condensate, and noncondensable gases therethrough.
Figure 4:
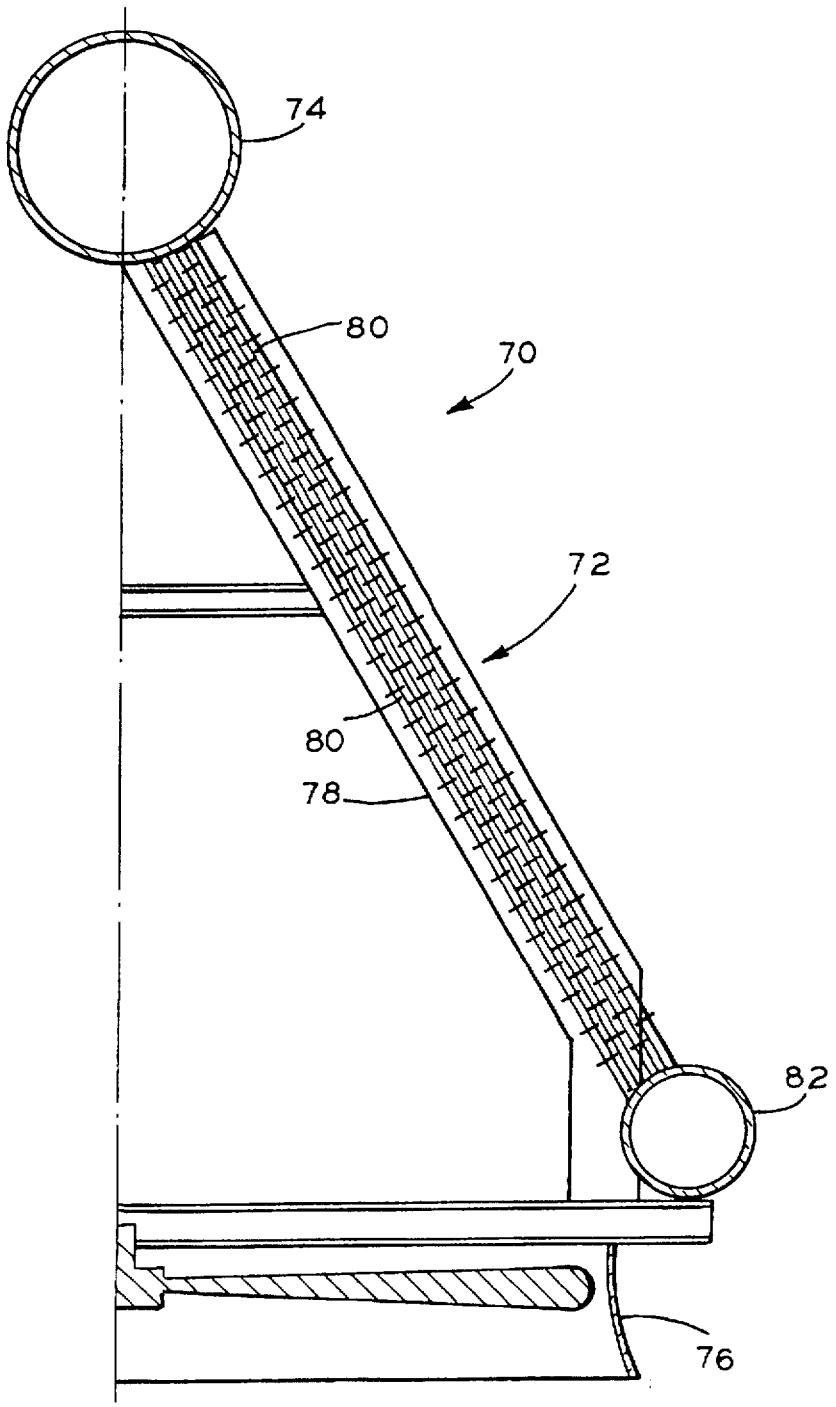
FIG. 4 is a sectional view, partially cut away, of the main condenser portion of the invention of FIG. 3 taken along lines 4—4 of FIG. 3.
Figure 5:
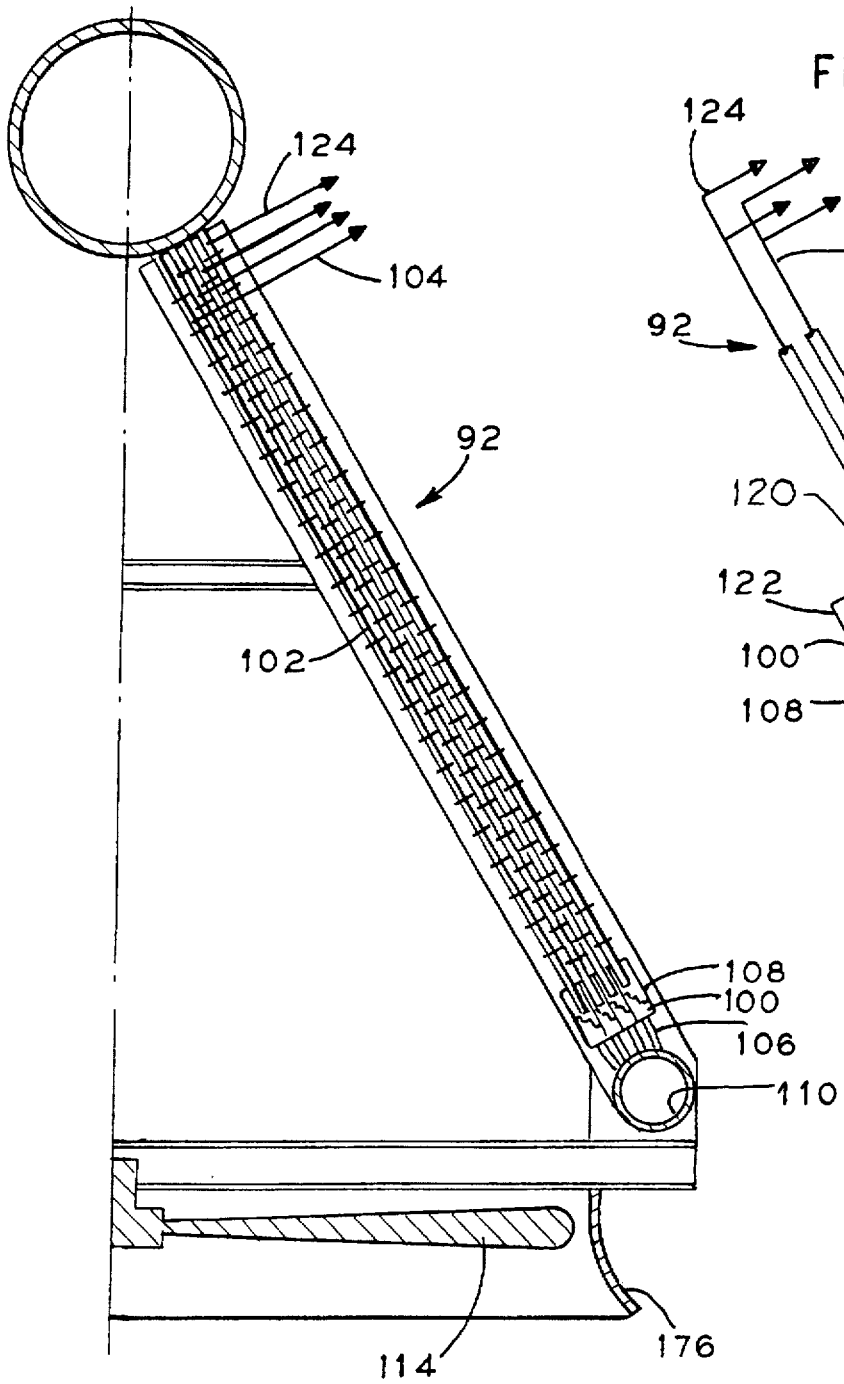
FIG. 5 is a sectional view, partially cut away, of the vent condenser portion of the invention of FIG. 3 taken along lines 5—5 of FIG. 3.

Referring now to FIGS. 3–5, there is shown one embodiment of the invention contemplated herein which is designed to overcome the disadvantages of the typical one- and two-stage steam condensers illustrated in FIGS. 1 and 2. In accordance with this invention, two-stage air-cooled steam condenser 70 is configured with main condenser 72 constructed in the typical A-frame shape having steam manifold 74 at the apex of the triangle and with one or more fans 76 forming its base. Angled or inclined tube bundles 78, each generally incorporating four (more or less) tube rows 80 therein, extend downward from steam manifold 74 and form the opposite sides of this triangle of main condenser 72. Each of these tube rows 80 drain into common lower header 82 attached to main condenser 72 in the normal fashion as shown. Steam 84 from steam manifold 74 and any resulting condensate 86 both flow downward through main condenser 72 toward common lower header 82.

The heat transfer surface area of main condenser 72 and the air flow of fan 76 are designed so that over the full range of operating conditions, steam 84 does not completely condense within main condenser 72. Instead, steam vapor 88 continuously exits each tube row 80 of each tube bundle 78 thereby continuously purging these tube rows 80 of main condenser 72 of any noncondensable gases therein. Such purging also equalizes the pressure in common lower header 82. Generally, main condenser 72 is constructed in modules 90 (typically 8 to 15 feet wide) so as to facilitate transportation and construction. This type of main condenser 72 is commonly used and is similar to that described above with respect to FIG. 2.

The novel aspects of air-cooled steam condenser 70 resides in the configuration of adjacent vent condenser 92 which completely condenses steam vapor 88. Such vapor 88 and any noncondensable gases 94 from main condenser 72 is, in this instance, directed upward in pipe 96 to the top of vent condenser 92 as shown. This is contrary to that known and used in the art which directs such products to the bottom of the adjacent secondary condenser (see FIG. 2). The vent condenser 92 contemplated herein is freeze protected by individually stacking independent tube rows 102 into a condenser flow module 98. Several condenser flow modules 98, each generally 8 to 15 feet wide in order to facilitate transportation and construction, are combined to form vent condenser 92.

Within vent condenser 92, the re-directed steam vapor 88 and resulting condensate 100 both flow concurrently downward from the upper region of vent condenser 92 (as compared with the flow arrangement of FIG. 2 which has such products flowing in opposite directions). The fluid within each tube row 102 of vent condenser 92 remains separate from that in adjacent tube rows 102 via independent air removal system 104 and by water leg seals in the various drain piping 106. These independent tube rows 102 and air removal systems 104 prevent any back flow of steam 88 in rows 102 as well as any trapping of noncondensable gases 94 therein which can lead to freezing. The separate drain piping 106 is, as shown, coupled to its respective compartment of divided lower discharge header 108. This drain piping 106 directs the resulting condensate 100 from vent condenser 92 to common pipe 110 which is located underneath lower discharge header 108. The height of water (or condensate 100) in each drain pipe 106 balances the differences in pressure between the divided discharge headers 108. However, in order for the water seal provided by drain piping 106 to operate as intended, common pipe 110 must be and remain completely filled so as to prevent any exchange of gas between adjacent drain piping 106 and lower discharge headers 108.

Such water level in common pipe 110 is maintained by weir pipe 112 located in drain pot 114. This weir pipe 112 is designed with its upper open end 116 above the elevation of common pipe 110. The maintenance of such water level in common pipe 110 also prevents any non-condensed vapor 88 from lower header 82 of main condenser 72 from entering divided discharge header 108 of vent condenser 92. However, since it is likely that two-stage air-cooled steam condenser 70 may require maintenance, the draining of this liquid in common pipe 110 and from lower header 82 of main condenser 72 is accomplished by inserting small holes 118 around the base of weir pipe 112 inside drain pot 114. These small holes 118 are sized to drain the liquid from drain pot 114 whenever steam condenser 70 is not operating but these small holes 118 are sized too small to pass the total liquid flowing into open end 116 of weir pipe 112. Also, as shown, common lower header 82 of main condenser is coupled to drain pot 114 so that any condensate 86 collected therein will drain through either open end 116 of weir pipe 112 or through small holes 118 in weir pipe.

Figure 5A:
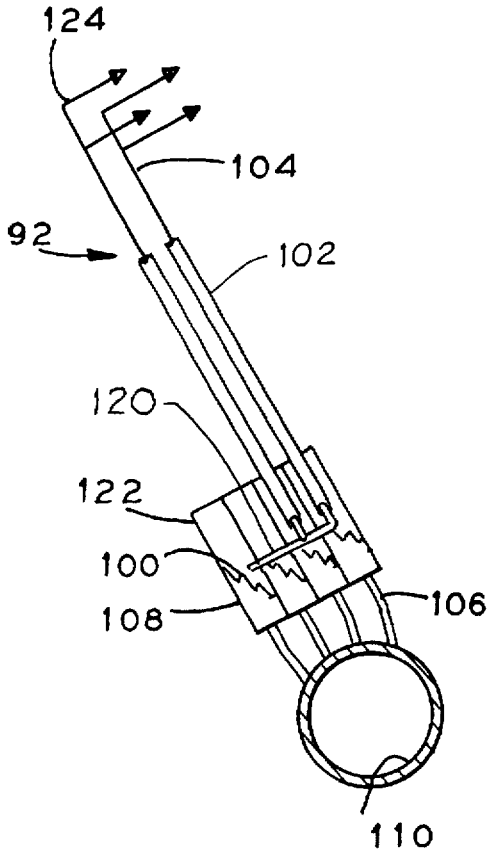
FIG. 5A is an exploded pictorial view of a portion of FIG. 5.

Referring now to FIGS. 5 and 5A, air removal system 104 of vent condenser 92 incorporates vent tubes 120 that are routed from the various compartments of divided discharge header 108 to various finned condenser tubes located primarily in the upper or outer tube rows 102 of vent condenser 92. For example, in FIG. 5A, vent tube 120 extends into the lowermost compartment 122 of divided discharge header 108 and is routed to a finned tube in the third tube row 102 (counting from the bottom toward the top) of vent condenser 92. Since generally noncondensable gas 94 will be concentrated in vent condenser 92, it is likely that multiple vent tubes 120 will be required for each divided discharge header 108 within each module 98. The individual finned tubes of the various tube rows 102 will permit steam vapor 88 to condense and flow downward toward divided lower discharge header 108 while noncondensable gas 94 flows upward toward the top of vent condenser 92 where it is ejected. This air removal system 104 maintains the independence of each tube row 102 by only connecting to individual finned tubes within a bundle or module 98, or from different bundles or modules 98, located in the same tube row 102. Thus, vent condenser 92 having four tube rows 102 will also have four main air removal pipes 124 associated with its air removal system 104. Each of these main air removal pipes 124 will be separately routed to the ejector or vacuum pump assembly (not shown) which discharges this noncondensable gas 94 to the atmosphere.

Figure 6:
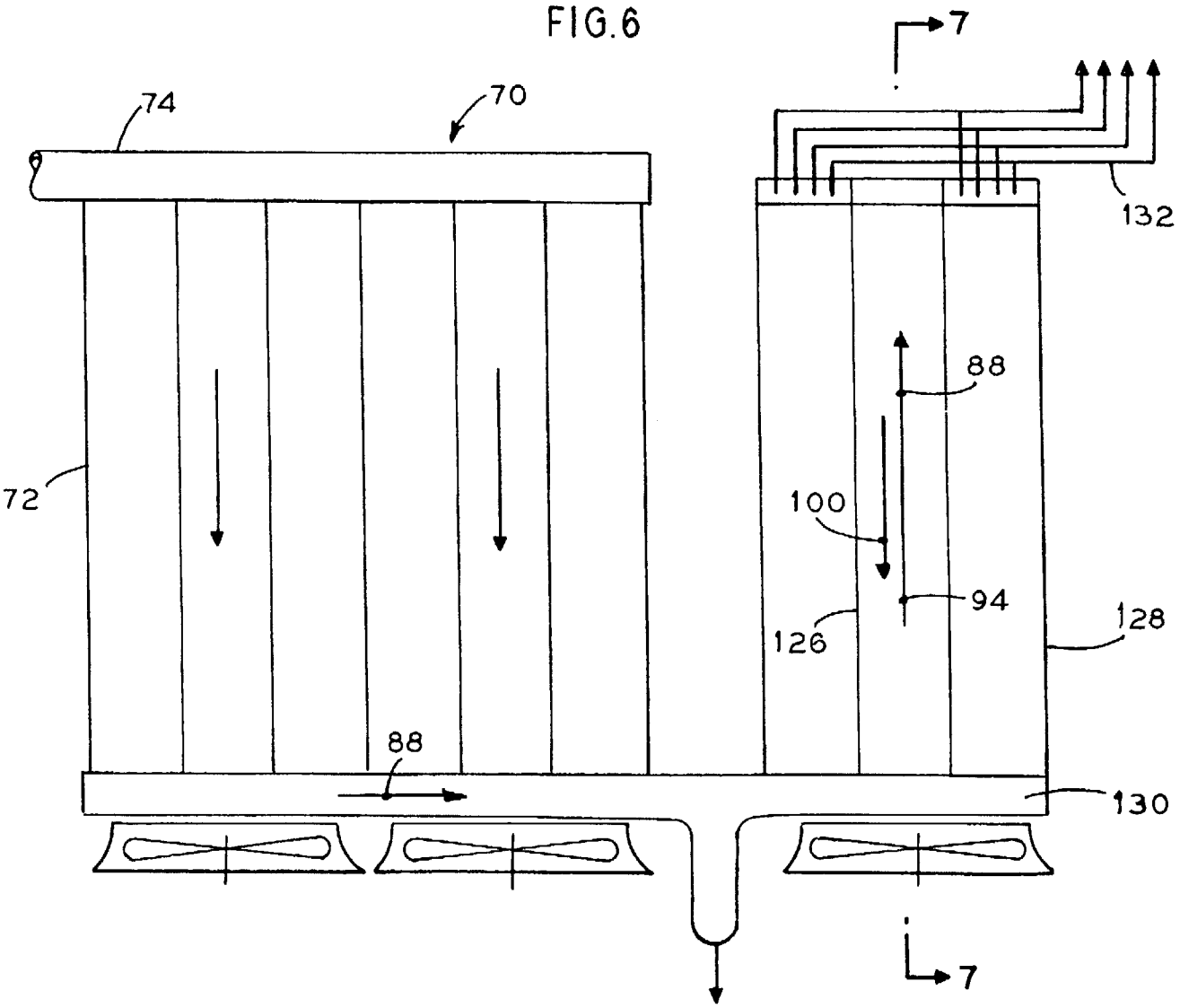
FIG. 6 is a pictorial view of another embodiment of the two-stage steam condenser comprising the invention described herein showing the main condenser and the vent condenser along with the direction of flow of the steam, condensate, and noncondensable gases therethrough.
Figure 7:
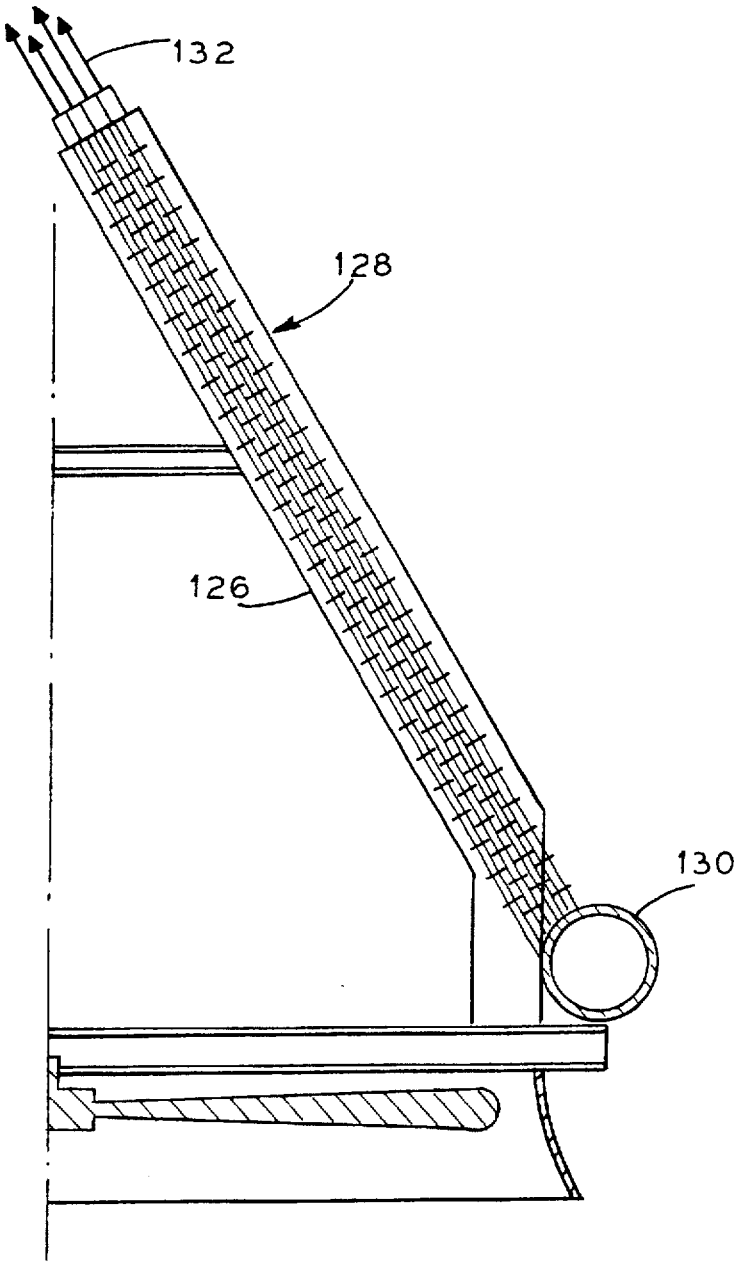
FIG. 7 is a sectional view, partially cut away, of the vent condenser portion of the invention of FIG. 6 taken along lines 7—7 of FIG. 6.

Referring now to FIGS. 6 and 7, there is shown an alternate embodiment of the invention from that disclosed in FIGS. 3–5. This alternate embodiment of two-stage air-cooled steam condenser 70 does not deliver vapor 88 and noncondensable gases 94 upward through pipe 96 to the top of adjacent vent condenser 92 as previously disclosed. Instead, this alternate embodiment stacks several rows of independent dephlegmators 126 together to comprise new vent condenser 128. In each of these independent dephlegmators 126, vapor 88 and noncondensable gases 94 flow concurrently upward while condensate 100 flows downward. This arrangement eliminates the need for the drain piping 106 and common pipe 110 of FIGS. 3–5 by substituting therefor a single common lower header 130 which is divided or compartmentalized between the various dephlegmators 126. This simplifies the condensate and vapor piping between main condenser 72 and this new design for vent condenser 128.

These stacked dephcogmators 126 are different from the conventional dephlegmator 44 of FIG. 2 in that each tube row of these stacked dephlegmators 126 have an independent air removal system 132 secured thereto. This independent air removal system 132 prevents any backflow of vapors 88 into the lower ends of the tube rows of each dephlegmator 126. Furthermore, air removal system 132 also prevents the trapping of noncondensable gases 94 in any tube row which can lead to freezing and subsequent rupture of the tube row.

Other alternate designs of two-stage air-cooled steam condenser 70 may include different proportions of the heat transfer surface area between main condenser 72 and vent condensers 92 or 128. The embodiments described herein illustrate vent condensers 92 and 128 having about one third of the total heat transfer surface area of steam condenser 70, but this value or proportion may vary depending on the amount of freeze-protection desired or required. Increasing the proportion of the surface area of vent condensers 92 or 128 will improve freeze-protection but such an increase will likely raise or boost the cost of steam condenser 70.

Also, while four independent tube rows of vent condensers 92 and 128 are shown and illustrated, more or fewer may actually be employed depending on conditions and specifications. It is also possible for main condenser 72 to have a different number of tube rows 80 from that of vent condensers 92 and/or 128.

An advantage associated with these embodiments of air-cooled steam condenser 70 include a reduction in the need for condensate and air removal system piping as compared to current models and designs. Such reduction in piping will result in a significant cost savings. Furthermore, these new designs for air-cooled steam condenser 70 eliminate the possibility that freezing will occur in vent condensers 92 or 128. This solves a major problem that has plagued typical steam condenser designs in the past.

Finally, steam condenser 70 may be configured differently than in the A-frame design shown herein. For example, the A-frame may be inverted so that the fans associated therewith will be located at the top of rather than underneath the steam condenser. This would result in a V-shaped design for the condenser tube bundles. Also, these tube bundles can be inclined at an angle other than the typical angle of 60 degrees presented herewith. Alternately, no fans would be required at all for systems that rely upon natural draft.

What is claimed is:

1. A two-stage air-cooled steam condenser comprising:

(a) main condenser means for partially condensing steam therein, said main condenser means having a common lower discharge header that both collects excess steam therein and discharges condensate into a drain pot;

(b) vent condenser means coupled downstream said main condenser means for condensing said excess steam, said vent condenser means comprising a plurality of independent tube rows that receive said excess steam from a common upper inlet header;

(c) piping means for delivering said excess steam from said common lower discharge header of said main condenser means to said common upper inlet header of said vent condenser means whereby said excess steam and resulting condensate flow concurrently downward within said vent condenser means;

(c) a compartmented lower discharge header secured to said vent condenser means, each said compartment being coupled to a said tube row for the segregated collection of condensate therein;

(d) separate drain means coupled to each said compartment for separately discharging said segregated condensate into said drain pot; and, (e) weir means in said drain pot for removing said condensate from said drain pot, said weir means having an entrance opening at an elevation above the discharge end of each said drain means.

2. The steam condenser as set forth in claim 1 wherein said drain means comprises a pipe intermediate said compartmented lower discharge header and said drain pot, said pipe discharging into said drain pot at an elevation below that of said entrance opening of said weir means.

3. The steam condenser as set forth in claim 2 further comprising at least one drain opening within said drain pot at the base of said weir means.

4. The steam condenser as set forth in claim 3 wherein said piping means drains into said drain pot.

5. The steam condenser as set forth in claim 4 wherein said main condenser means and said vent condenser means are modular.

6. The steam condenser as set forth in claim 5 further comprising air ejector means coupled to each said compartment of said lower discharge header of said vent condenser means for the independent discharge of air therefrom, said discharge of air therefrom occurring countercurrent to the flow of said excess steam and resulting condensate in said vent condenser means.

7. A method of condensing steam in a two-stage air-cooled steam condenser comprising the steps of:

(a) partially condensing steam in a main condenser assembly, said main condenser assembly having a common lower discharge header that both collects excess steam therein and discharges condensate into a drain pot;

(b) condensing said excess steam in a vent condenser assembly coupled downstream said main condenser assembly, said vent condenser assembly comprising a plurality of independent tube rows that receive said excess steam from a common upper inlet header;

(c) delivering said excess steam via a piping assembly extending from said common lower discharge header of said main condenser assembly to said common upper inlet header of said vent condenser assembly whereby said excess steam and resulting condensate flow concurrently downward within said vent condenser assembly;

(c) securing a compartmented lower discharge header to said vent condenser assembly, each said compartment being coupled to a said tube row for the segregated collection of condensate therein;

(d) coupling separate drain means to each said compartment for separately discharging said segregated condensate into said drain pot; and, (e) constructing and arranging a weir assembly in said drain pot for removing said condensate from said drain pot, said weir assembly having an entrance opening at an elevation above the discharge end of each said drain means.

8. The method as set forth in claim 7 further comprising the step of constructing and arranging said drain means with a pipe intermediate said compartmented lower discharge header and said drain pot, said pipe discharging into said drain pot at an elevation below that of said entrance opening of said weir assembly.

9. The method as set forth in claim 8 further comprising the step of constructing and arranging at least one drain opening within said drain pot at the base of said weir assembly.

10. The method as set forth in claim 9 further comprising the step of draining said piping assembly into said drain pot.

11. The method as set forth in claim 10 further comprising the step of constructing and arranging said main condenser assembly and said vent condenser assembly as a combination of separate modules.

12. The method as set forth in claim 11 further comprising the step of coupling an air ejector assembly to each said compartment of said lower discharge header of said vent condenser assembly for the independent discharge of air therefrom, said discharge of air therefrom occurring countercurrent to the flow of said excess steam and resulting condensate in said vent condenser assembly.

* * * * *